US006913008B2

(12) United States Patent
Simo et al.

(10) Patent No.: US 6,913,008 B2
(45) Date of Patent: Jul. 5, 2005

(54) APPARATUS FOR HOLDING ARROW

(75) Inventors: Miroslav A. Simo, Riverside, IL (US); Frank A. Harwath, Downers Grove, IL (US); Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/345,828

(22) Filed: Jan. 16, 2003

(65) Prior Publication Data

US 2004/0139952 A1 Jul. 22, 2004

(51) Int. Cl.[7] ..... F41B 5/22
(52) U.S. Cl. ..... 124/44.5
(58) Field of Search ..... 248/49, 65, 67.7; 269/302; 124/24.1, 44.5

(56) References Cited

U.S. PATENT DOCUMENTS

| | | | | | |
|---|---|---|---|---|---|
| 163,531 | A | * | 5/1875 | Roake | 248/65 |
| 1,336,928 | A | * | 4/1920 | Simmons | 335/285 |
| 1,999,791 | A | * | 4/1935 | Siegfried | 248/49 |
| 2,186,386 | A | * | 1/1940 | Lowell | 124/24.1 |
| 2,699,601 | A | * | 1/1955 | Darnell | 269/40 |
| 3,760,788 | A | * | 9/1973 | Hartman | 124/44.5 |
| 4,453,528 | A | | 6/1984 | Eckert | |
| 4,513,934 | A | * | 4/1985 | Pruyne | 248/49 |
| 4,598,688 | A | * | 7/1986 | Paul et al. | 124/44.5 |
| 4,685,439 | A | | 8/1987 | Cosentino, Jr. | |
| 4,803,971 | A | | 2/1989 | Fletcher | |
| 4,967,722 | A | * | 11/1990 | Roberts | 124/44.5 |
| 5,205,267 | A | * | 4/1993 | Burdick | 124/24.1 |
| 5,365,912 | A | | 11/1994 | Pittman | |
| 5,394,858 | A | | 3/1995 | Karolian | |
| 5,415,154 | A | | 5/1995 | Angeloni | |
| 5,490,492 | A | | 2/1996 | Savage | |
| 5,522,375 | A | | 6/1996 | Simo et al. | |
| 5,603,309 | A | * | 2/1997 | Sheliga | 124/44.5 |
| 5,632,263 | A | | 5/1997 | Sartain | |
| 5,685,287 | A | * | 11/1997 | Greywall | 124/44.5 |
| 5,722,381 | A | | 3/1998 | Mizek | |
| 5,743,245 | A | | 4/1998 | Mizek | |
| 5,992,402 | A | * | 11/1999 | Vyprachticky | 124/44.5 |
| 6,044,832 | A | | 4/2000 | Piersons, Jr. | |
| 6,050,251 | A | | 4/2000 | Harwath et al. | |
| 6,089,216 | A | | 7/2000 | Harwath et al. | |
| 6,102,020 | A | | 8/2000 | Mizek et al. | |
| 6,182,930 | B1 | * | 2/2001 | Lindborg | 248/49 |
| 6,202,635 | B1 | | 3/2001 | Evans | |
| 6,615,813 | B1 | | 9/2003 | Troncoso, Jr. et al. | |
| 6,634,349 | B2 | | 10/2003 | Mizek et al. | |

OTHER PUBLICATIONS

*The Bowman's Not So Ordinary Archery Catalog, Internet Publication*, pp. 1 of 4–3 of 4, Dec. 27, 2001.
*Lexco, Internet Publication*, pp. 1 of 3–3 of 3, Jan. 15, 2002.

* cited by examiner

*Primary Examiner*—John A. Ricci
(74) *Attorney, Agent, or Firm*—Pauley Petersen & Erickson

(57) ABSTRACT

An apparatus for holding an arrow with respect to an archery bow, particularly when the archery bow is carried and moved into different positions. The holding apparatus has a base portion preferably but not necessarily integrated with an upper portion. The upper portion has two opposing walls spaced apart from each other and extending outward from a top surface of the base portion. The opposing walls form a void within which a shaft of an arrow fits.

18 Claims, 7 Drawing Sheets

APPARATUS FOR HOLDING ARROW

BACKGROUND OF THE INVENTION

1. Field of the Invention

This invention relates to a move-away or drop-away arrow rest that pivots between a first position and a second position with respect to an archery bow and that also moves away from an arrow shaft and fletching when an arrow is launched or discharged from the archery bow. This invention also relates to an apparatus for holding an arrow with respect to the archery bow, particularly when the arrow is loaded on a bow string of the archery bow, in an unloaded or at rest condition.

2. Discussion of Related Art

Some conventional arrow rests move away, drop away, fall away or are otherwise forced away from an arrow shaft as an arrow is launched or discharged from the archery bow. It is known to use a return bias force to move the arrow rest away from the arrow when the arrow is discharged. In conventional arrow rests having the move-away or drop-away feature, flexible elastic members, such as rubber tubing, string, cords or the like have been used to overcome the return bias force and thus move the arrow rest from its biased position. Once the return bias force is overcome, the arrow rest moves into a second or loaded position, to support the arrow shaft prior to launching the arrow.

Conventional flexible members are in a tension condition when the bow string is drawn back, into the loaded position. As the bow string is drawn back, conventional flexible members stretch until they can stretch no further or until the return bias force of the arrow rest is overcome and the arrow rest moves into a loaded position. One problem with some conventional flexible members is that when the bow string is released, the length of the flexible member decreases for a certain relatively short time period, until the return bias force of the arrow rest can again overcome the tension force in the flexible elastic member and thus return the arrow rest to the unloaded position. However, even with the relatively short time period the arrow shaft is discharged before the conventional flexible elastic member allows the arrow rest to move sufficiently away from the loaded position. Thus, the arrow shaft and the fletching of an arrow move across the arrow rest before the arrow rest can drop away and provide the necessary clearance for the arrow shaft and the fletching to completely clear the arrow rest.

Some conventional flexible members have a flexible member with one end that attaches directly to a bow cable. If an end portion of a flexible member is attached to a downwardly acting tuning cable, such cable can travel as much as 4 to 5 inches as the archery bow is drawn or released. Because of such travel distance, the end portion of any connected flexible member must also travel such distance. Traveling such distance can also increase the time period that is required for the return bias force to overcome the tension force applied by the flexible member, when an arrow is discharged from the archery bow.

Other conventional arrow rests that drop away or move away from the loaded position, or are normally biased into an unloaded position, have a rigid member or linkage between the bow cable and the arrow rest. The rigid member overcomes the problems associated with the flexible elastic member. However, rigid linkages are difficult to finely tune or are relatively intricate.

SUMMARY OF THE INVENTION

It is one object of this invention to provide a pivotally mounted arrow rest that instantaneously or immediately moves away from an arrow when a bow cable moves forward during launch or discharge of the arrow.

It is another object of this invention to provide a holding apparatus that holds an arrow shaft near an arrow rest, when the arrow is loaded in an archery bow, in a condition where a bow string of the archery bow is not yet drawn back, or at rest.

The move-away or drop-away arrow rest and the arrow holder, both of this invention, can be used either together or as individual pieces of archery equipment. When used together, the holding apparatus holds the arrow shaft near a bow riser or a bow handle of the archery bow, when a nock end of the arrow is loaded on the bow string but the bow string is not yet drawn back far enough to pivot the arrow rest into a loaded position. At the same time that the arrow rest is pivoted into the loaded position, the arrow rest lifts or otherwise moves the arrow shaft out of the holding apparatus.

When the arrow shaft is positioned within the holding apparatus, such as when the arrow rest is in the unloaded position, the archery bow can be carried or moved into many different positions and the holding apparatus maintains the arrow shaft in a generally fixed position with respect to the archery bow. The holding apparatus of this invention prevents the arrow shaft from falling off of a shelf of the riser portion.

In one embodiment of this invention, the holding apparatus is wider than a diameter of the arrow shaft and thus the arrow shaft can move, to a limited extent, within the holding apparatus. The limited movement is acceptable because when the arrow rest moves into a loaded position, the arrow rest contacts and self-centers the arrow shaft with respect to the arrow rest and precisely positions the arrow shaft in a shooting window. In one embodiment of this invention, the arrow rest has two prongs that are spaced apart from each other. The prongs can easily center the arrow shaft on the arrow rest by simply using gravity forces.

In one embodiment of this invention, inside surfaces of walls forming the holding apparatus have a matte finish that provides enough friction between the inside surface and the arrow shaft to hold the arrow shaft within the holding apparatus, even when the archery bow is rotated, tilted or otherwise moved. Such feature allows an archer to mount an arrow by attaching a nock end to the bow string, and place the arrow shaft within the holding apparatus. When the bow string is not drawn back far enough to lift a pivotal arrow rest, in one embodiment, the walls frictionally hold the arrow shaft. Thus, an archer can load an arrow with respect to a bow and place the arrow shaft within the holding apparatus, and then carry the bow through different field conditions, without the arrow shaft falling or otherwise moving away from an area of the bow riser. When an archer spots a target, the archer can then place the archery bow into a firing position. With the pivotal arrow rest according to this invention, the archer can then draw the bow string and thereby pivot the arrow rest into a loaded position, which lifts the arrow shaft out of and away from the holding apparatus. When the arrow is discharged from the archery bow, neither the arrow shaft nor the fletching contact or interfere with the arrow rest or with the holding apparatus.

When an arrow rest can instantaneously or immediately pivot or otherwise move away from the arrow shaft and the fletching during launch or discharge of an arrow, there is a much greater chance that the arrow rest will not interfere with a flight path of the arrow. The arrow rest according to this invention uses a flexible inelastic member as a linkage between the bow cable and the arrow rest. Because the flexible member of this invention is also inelastic, there is no relatively short time period necessary, such as associated with the previously discussed conventional arrow rests, for the flexible inelastic member of this invention to decrease in length. The flexible inelastic member of this invention instantaneously or immediately overcomes the return bias force and thus the arrow rest of this invention instantaneously or immediately begins acting to move the arrow rest away from the discharged arrow.

In one embodiment of this invention, the flexible inelastic member is a cable that preferably but not necessarily has an outer coating or a sheath. In another embodiment of this invention, the flexible inelastic member is a plastic rod. The flexible inelastic member according to this invention preferably has a relatively low modulus of elasticity, which provides a relatively low resistance to bending.

Relatively high-speed photography has shown that in many conventional drop-away or move-away arrow rests, the arrow rest does not move away from and provide necessary clearance for the arrow shaft and/or the fetching. In such conventional arrow rests, the arrow shaft and/or the fletching contact the arrow rest during discharge movement of the arrow with respect to the archery bow. The flexible inelastic member of the arrow rest according to this invention, provides instantaneous movement of the arrow rest away from the arrow, at the same time that the bow cable moves forward during discharge of the arrow.

BRIEF DESCRIPTION OF THE DRAWINGS

The above and other features and objects of this invention will be better understood from the following detailed description taken in view of the drawings wherein.

DESCRIPTION OF PREFERRED EMBODIMENTS

Figure 1:
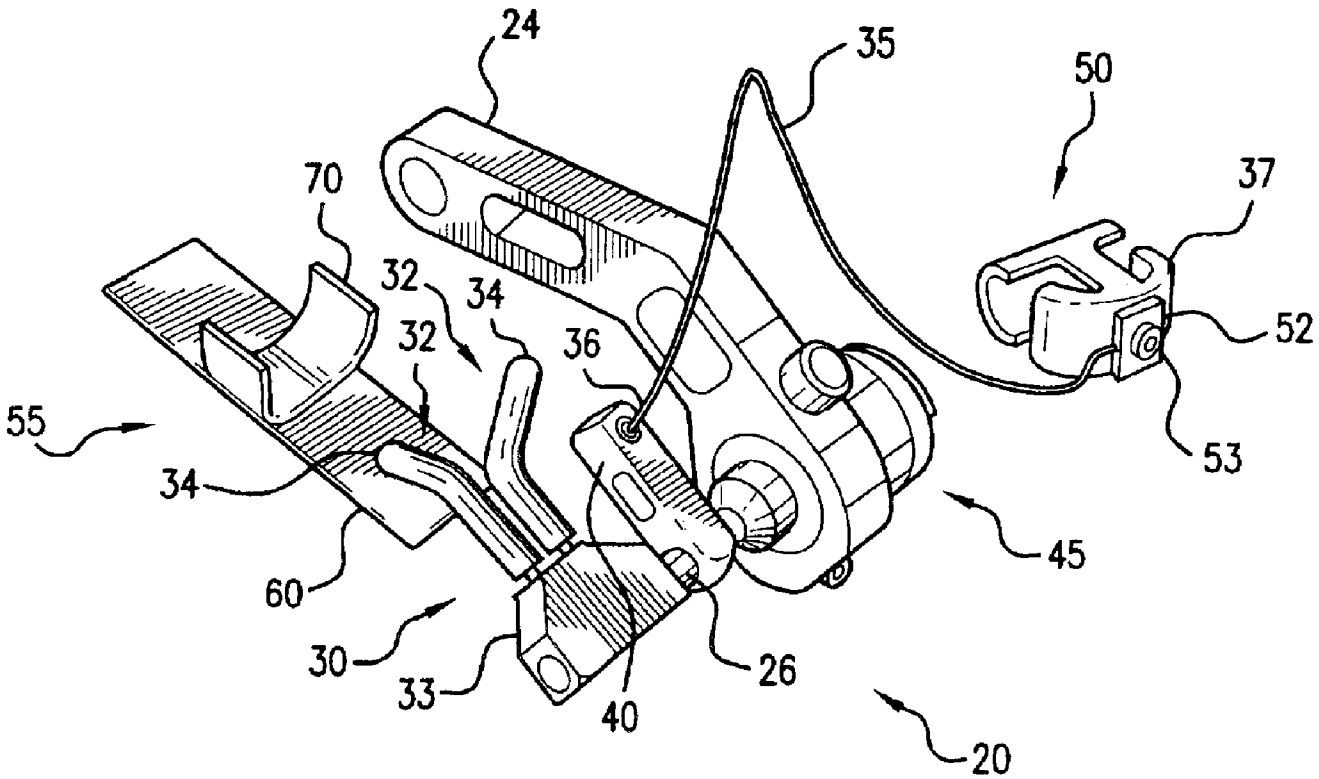
FIG. 1 is a perspective view of an arrow rest and a holding apparatus, according to one embodiment of this invention.

FIG. 1 shows a perspective view of arrow rest 20 and holding apparatus 55, according to one embodiment of this invention. As shown in FIG. 1, arrow rest 20 and holding apparatus 55 are separate individual components. Bracket 24 or any other similar structure can be used to attach arrow rest 20 with respect to archery bow 15. Holding apparatus 55 can be secured with respect to archery bow 15 using double-sided tape or another suitable adhesive or adhesive layer.

When arrow rest 20 is mounted with respect to archery bow 15, at least one arm 21, two arms 21 as shown in FIG. 1, each is pivotally mounted with respect to archery bow 15. Cable slide 50 is attached with respect to at least one bow cable 17 of archery bow 15.

Figure 10:
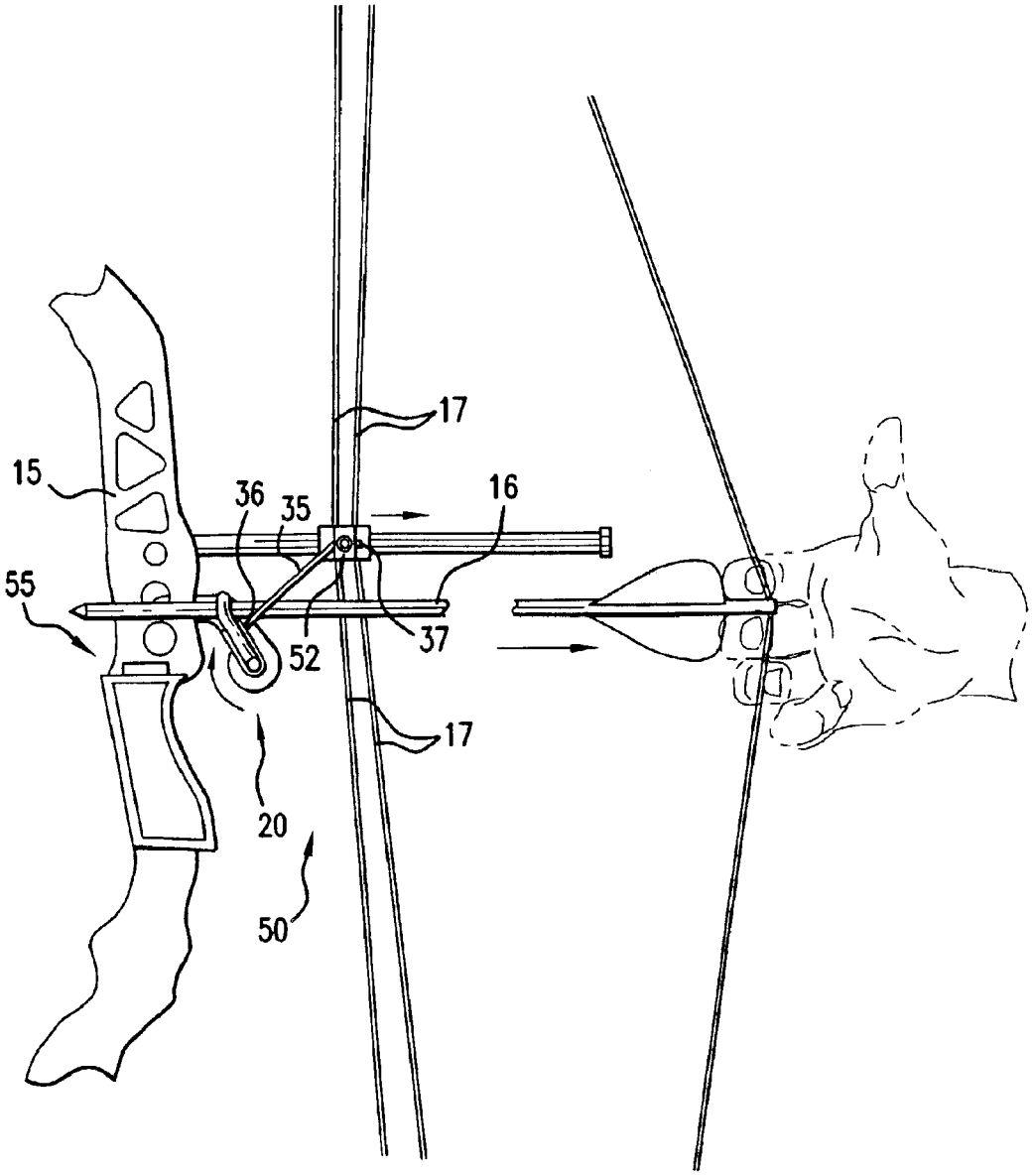
FIG. 10 is a diagrammatic view of an arrow and an arrow rest in a loaded position, according to one embodiment of this invention.
Figure 11:
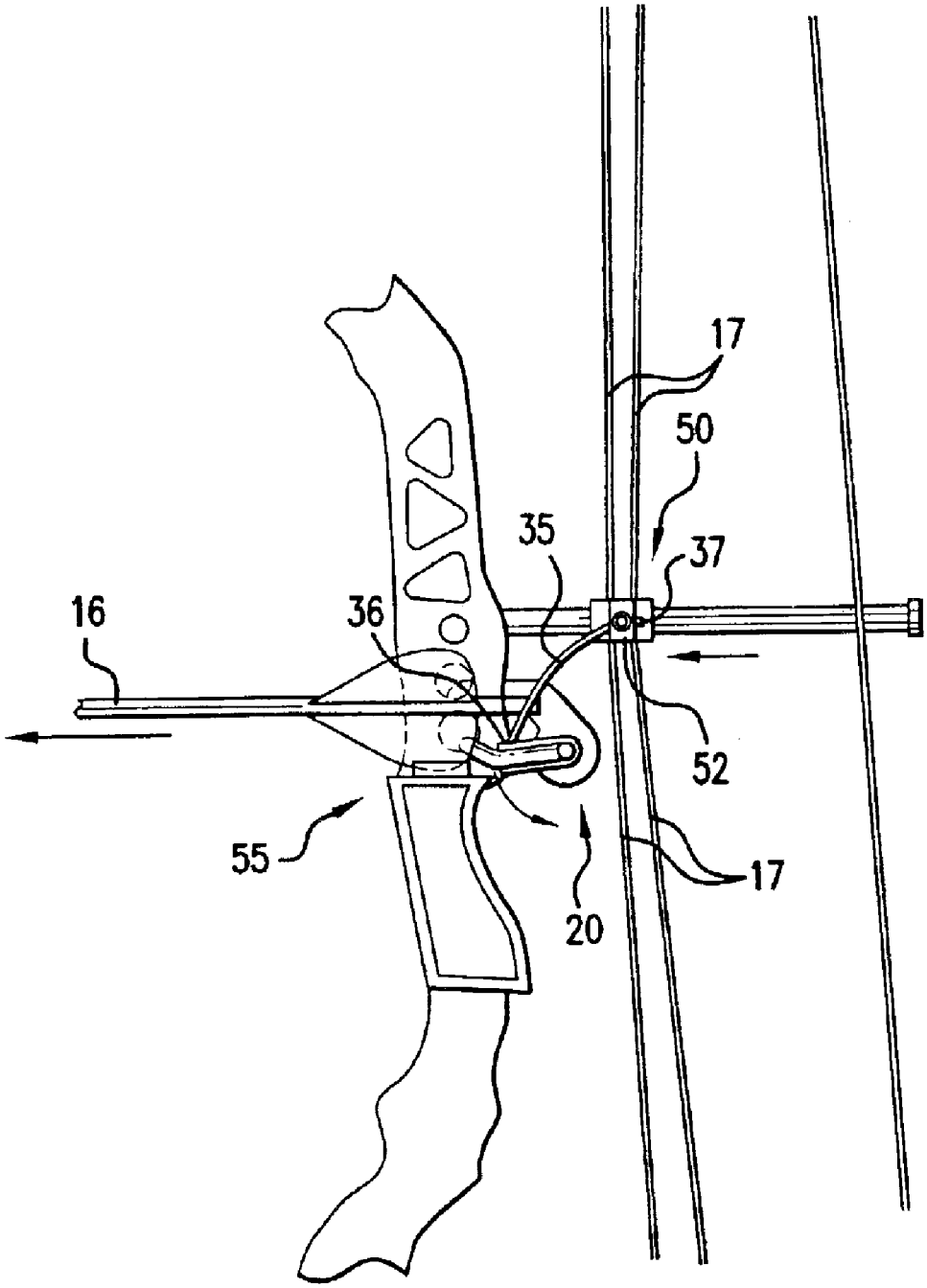
FIG. 11 is a diagrammatic view of an arrow rest in an unloaded position, with the arrow being discharged from the archery bow.

As shown in FIG. 1, support element 30 pivots or is otherwise moveable between a first position and a second position, such as an unloaded position and a loaded position, of support element 30 with respect to archery bow 15. FIGS. 10 and 11 show diagrammatic views of arrow rest 20 in a loaded position and an unloaded position, respectively. FIG. 10 shows arrow 16 in a loaded position, ready to be fired or discharged from archery bow 15, wherein support element 30 is pivoted into a loaded position. In the position shown in FIG. 10, arrow 16 is not positioned within holding apparatus 55.

FIG. 11 shows a diagrammatic view of arrow 16 being discharged with respect to archery bow 15. Instantaneously or immediately with the discharge motion of arrow 16, support element 30 moves toward the unloaded or at rest position with respect to archery bow 15, such as shown in FIG. 11.

In the unloaded position, such as shown in FIG. 11, a bias force normally urges support element 30 into the unloaded or at rest condition. With arrow 16 loaded in archery bow 15, when the archery bow string is not drawn, the shaft of arrow 16 can be held in position within holding apparatus 55. Although arrow rest 20 of this invention can be used without holding apparatus 55, when used with holding apparatus 55, arrow 16 can be supported by upper portion 70 of holding apparatus 55 when in an unloaded position. When the bow string is drawn back, cable 17 moves away from archery bow 17 and thus causes tension in cable 35, and support element 30 pivots into the loaded position and raises arrow 16 away from holding apparatus 55 and/or away from the riser portion of archery bow 15. When cable 35 reaches a taut condition, cable 35 exerts a force that pulls support element 30, against the return bias force acting on support element 30, with enough force to move or pivot support element 30 towards the loaded position.

Figure 2:
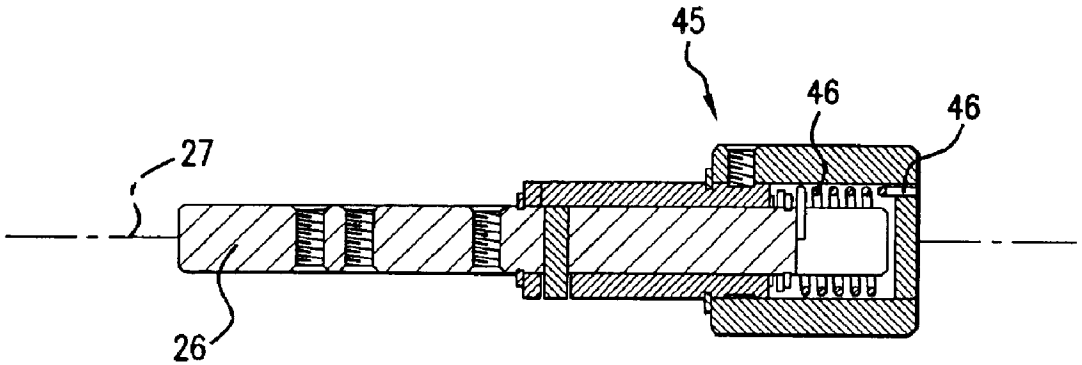
FIG. 2 is a sectional view taken along a longitudinal axis, of an adjustment device, according to one embodiment of this invention.

FIG. 2 shows a sectional view, taken along longitudinal pivot axis 27. As shown in FIG. 1, pivot end portion 33 of support element 30 is adjustably mounted or attached with respect to pivot shaft 26. As shown in FIG. 1, a set screw can be used to loosen and tighten and thereby adjustably mount support element 30 with respect to pivot shaft 26.

As shown in FIGS. 1 and 2, adjustment device 45 is used to adjust the horizontal and vertical position of support element 30, with respect to archery bow 15. The internal components of adjustment device 45, according to one embodiment of this invention, are shown in FIG. 2. However, other conventional adjustment devices can be used to provide horizontal, vertical and/or radial adjustment. For example, U.S. Pat. No. 6,050,251, the entire teachings of which are incorporated into this specification by reference to U.S. Pat. No. 6,050,251, discloses an apparatus for adjustably mounting a pivotal arrow rest with respect to an archery bow. Any other suitable adjustment device known to those skilled in the art can be used as adjustment device 45 of this invention.

As shown in FIG. 2, bias element 46 is a coil spring that has opposing end portions acting between pivot shaft 26 and the end cap which is fixed with respect to archery bow 15. Bias element 46 urges pivot shaft 26 into a position where support element 30 is in the unloaded or at rest position, as shown in FIG. 11. Any other suitable spring or bias element can be used in addition to or in lieu of bias element 46 as shown in FIG. 2 to accomplish the same result of urging support element 30 into the unloaded position.

According to one embodiment of this invention, as shown in FIG. 1, support element 30 comprises at least one arm 32. Each arm 32 has pivot end portion 33 and an opposite free end portion 34. When moving from the unloaded position to the loaded position, free end portion 34 contacts the shaft of arrow 16 and moves arrow 16 into a loaded position. As shown in FIG. 1, each arm 32 pivots about pivot axis 27. As shown between FIGS. 1 and 2, pivot axis 27 is positioned within pivot end portion 33 of support element 30. Support element 30 can have any suitable configuration, shape or structure that supports an arrow shaft, and can be an integrated element or can comprise a plurality of elements. With the forked configuration of support element 30, as shown in FIG. 1, the shaft of arrow 16 can be repeatedly placed into the same position. According to the configuration shown in FIG. 1, during movement from the unloaded position to the loaded position, support element 30 moves radially, with respect to archery bow 15.

As shown in FIGS. 1, 10 and 11, cable slide 50 is configured for detachable attachment to at least one cable 17 of archery bow 15. Flexible inelastic member 35 is connected, directly or indirectly, between support element 30 and cable 17, so that when the bow string of archery bow 15 is drawn back, cable 17 moves away from arrow rest 20 and tightens or puts flexible inelastic member 35 into a tension condition, enough to straighten flexible inelastic member 35 or to place flexible inelastic member 35 into a taut condition. In one embodiment of this invention, flexible inelastic member 35 has end portion 36 fixed with respect to support element 30 and has an opposite end portion 37 fixed with respect to cable 17 of archery bow 15. End portion 36 is operatively connected to support element 30. Drawing cable 17 rearward or away from arrow rest 20 eventually removes all slack and puts flexible inelastic member 35 into a taut condition where both opposing sides or all sides of flexible inelastic member 35 are in a tension condition. When cable 17 is drawn far enough back, away from arrow rest 20, the generated drawing force is transferred by or through the tension in flexible inelastic member 35 and eventually overcomes the return bias force of bias element 46 and thus allows support element 30 to move into the loaded condition, such as shown in FIG. 10.

Simultaneously with or as soon as cable 17 begins a forward movement during launch of arrow 16, flexible inelastic member 35 instantaneously or immediately allows the bias force of bias element 46 to return support element 30 back into the unloaded position. Because flexible inelastic member 35 has properties that are relatively inelastic, there is either no time delay or a relatively insignificant time delay associated with support element 30 returning to an unloaded position. The relatively insignificant time delay is further defined as a short enough time period to allow support element 30 to move out of the way of and provide clearance for arrow 16, which is often discharged at a relatively high acceleration and velocity.

As used throughout this specification and/or in the claims, the term flexible inelastic member is intended to relate to a member, preferably an elongated member, that is capable of bending or flexing and thus is flexible but also is inelastic, inelastic at least to the extent that the flexible inelastic member either does not elongate or elongates only an incremental amount which would provide a relatively insignificant time delay between cable 17 moving forward and support element 30 initiating a return movement towards the unloaded position. For example, flexible inelastic member 35 may comprise a cable, such as a braided and/or twisted steel cable or any other suitable metal and/or non-metal cable. In another embodiment, flexible inelastic member 35 may comprise a rod, such as one of a polymeric material. Also as used throughout this specification and/or in the claims, the term flexible inelastic member is intended to be interchangeable with the term cable.

In one embodiment of this invention, cable 35 is surrounded by a sheath. The sheath may comprise a polymeric material, a fiber material, a metal material, a composite material or any other suitable and similar material that preferably has a relatively low modulus of elasticity. When cable 35 is not taut and thus is in a bent or non-straight position, cable 35, the sheath and/or a coating has one side in tension and another side, such as the opposite side, in compression, so that cable 35 has a natural tendency to straighten itself when put into a bent or non-straight condition, particularly when support element 30 is not in the loaded position. Because cable 35 has one side in tension and another side in compression, cable 35 has a normal tendency to straighten itself further, which allows or assists the instantaneous or immediate movement of support element 30 when arrow 16 is discharged from archery bow 15. The instantaneous or immediate movement of support element 30 of this invention is different than many conventional pivotal arrow rests that have a move away feature, because cable 35 of this invention is inelastic or nearly inelastic or substantially inelastic, whereas with conventional pivotal arrow rests, the flexible member is relatively elastic, which significantly increases the time period before support element 30 begins to move away from arrow 16, during discharge from archery bow 15.

The natural tendency of cable 35 to straighten itself when in a bent or non-straight condition allows cable 35 to remain in a path or area, relative to arrow rest 20, that keeps or maintains cable 35 away from a loaded or discharging arrow 16. When in the bent or non-straight condition, the curvature of cable 35, such as shown in FIGS. 1 and 11, is relatively gradual and/or smooth with no abrupt direction changes or kinks. The bend in cable 35 can be relatively slight, such as shown in FIG. 11, can smoothly bend over about a 90° curve, or can have any other suitable and preferably gradual bend. This feature allows cable 35 to be tuned or arranged in length and/or position to maintain a distance from and thus establish clearance for arrow 16. As discussed below, this invention allows for simple adjustment of the length of cable 35.

In one embodiment of this invention, cable 35 may be constructed using a 7×7 strand wire, such as manufactured by LEXCO, Chicago, Ill. The sheaths or coating for cable 35 can be constructed of KEVLAR® brand fiber or material, as manufactured by DuPont Company.

End portion 36 of cable 35 can be secured with respect to lever 40 or can be moveably mounted with respect to lever 40. For example, end portion 36 can have an enlarged section, such as a cylindrical section, that fits within a bore of lever 40. When support element 30 is in the loaded position, the enlarged section or cylindrical section of end portion 36 interferes with lever 40 and thereby forces lever 40 in a direction towards cable slide 50. In one embodiment of this invention, the enlarged section has an outer diameter which is greater than an outer diameter of cable 35. The enlarged section or cylindrical section can be moveably positioned within the bore of lever 40.

As shown in FIG. 1, lever 40 is adjustably secured, for example with a set screw, with respect to pivot shaft 26. Lever 40 can be a separate element from support element 30 or can be integrated with support element 30. As shown in FIG. 1, lever 40 is a separate element from support element 30.

End portion 37 of cable 35 is secured with respect to cable slide 50. In one embodiment of this invention, such as shown in FIG. 1, cable slide 50 has two bores or grooves or openings to accept two cables 17. In one embodiment of this invention, cable slide 50 is slidably mounted on a rod attached with respect to archery bow 15, such as on a conventional bow cable guide. Any suitable cable slide known to those skilled in the art of archery components can be used in place of cable slide 50 as shown in FIG. 1. Any cable slide 50 is preferably detachably attached to one or more cables 17 of archery bow 15.

As shown in FIG. 1, according to one embodiment of this invention, clamp 52 is used to secure end portion 37 of cable 35 with respect to cable slide 50. Clamp 52 can be operated between a closed position and an open position, such as by using an externally threaded member 53 which is threadedly engaged within an internally threaded bore of cable slide 50. In one embodiment of this invention, threaded member 53 comprises a screw. Threaded member 53 can be used to secure clamp 52 with respect to cable slide 50 and thereby clamp or crimp or sandwich end portion 37 of cable 35 between clamp 52 and cable slide 50. Threaded member 53 provides easy adjustment capabilities for varying the operating length of cable 35.

Figure 3:
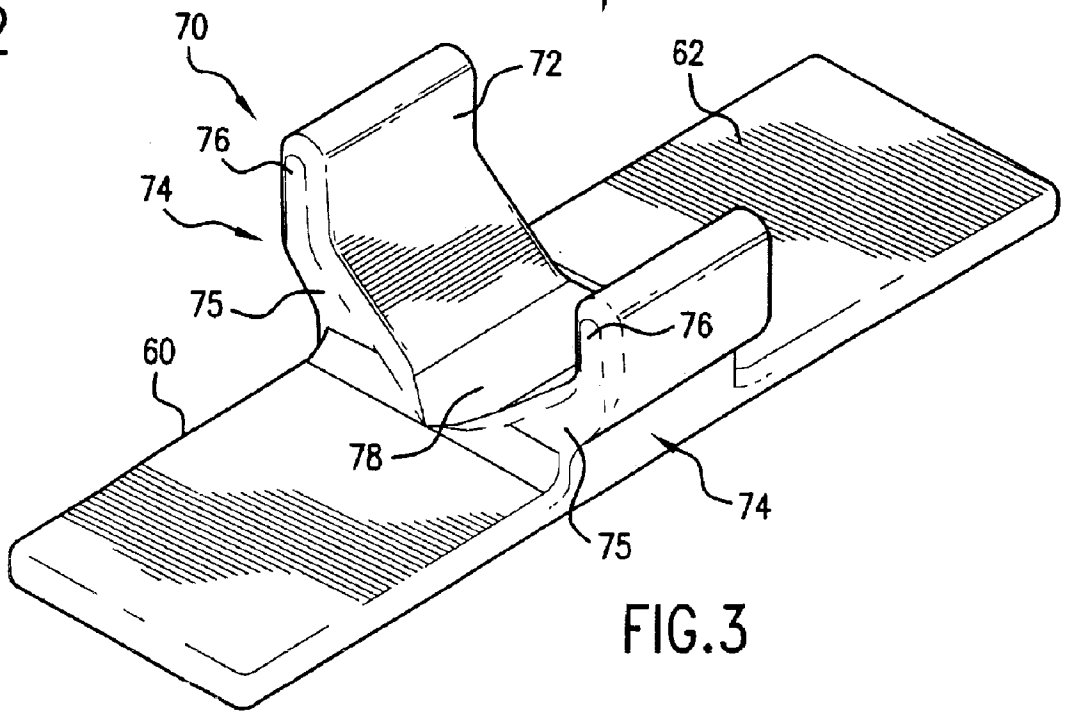
FIG. 3 is a perspective view of a holding apparatus, according to one embodiment of this invention.
Figure 4:
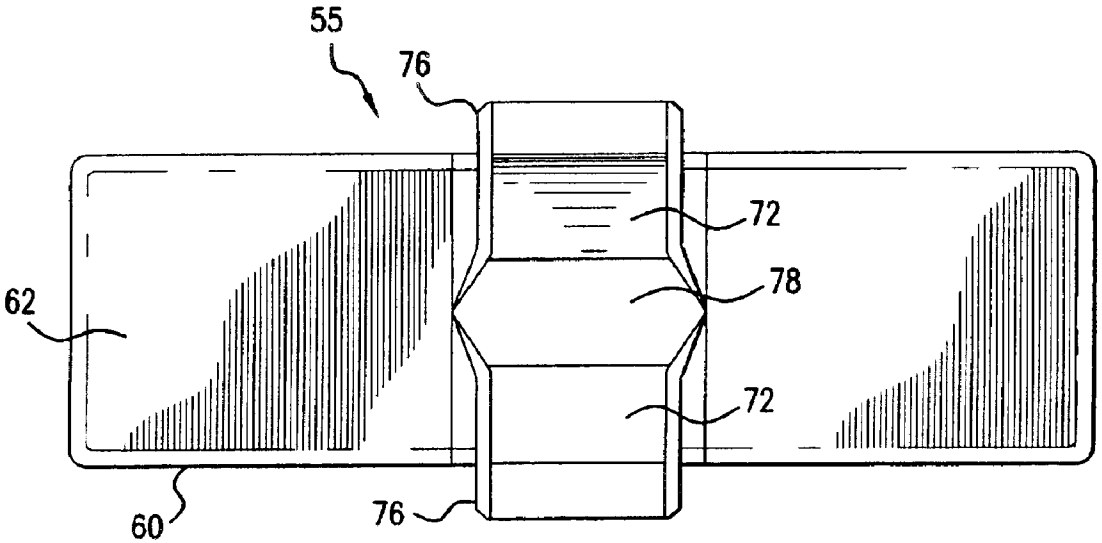
FIG. 4 is a top view of the holding apparatus, as shown in FIG. 3.
Figure 5:
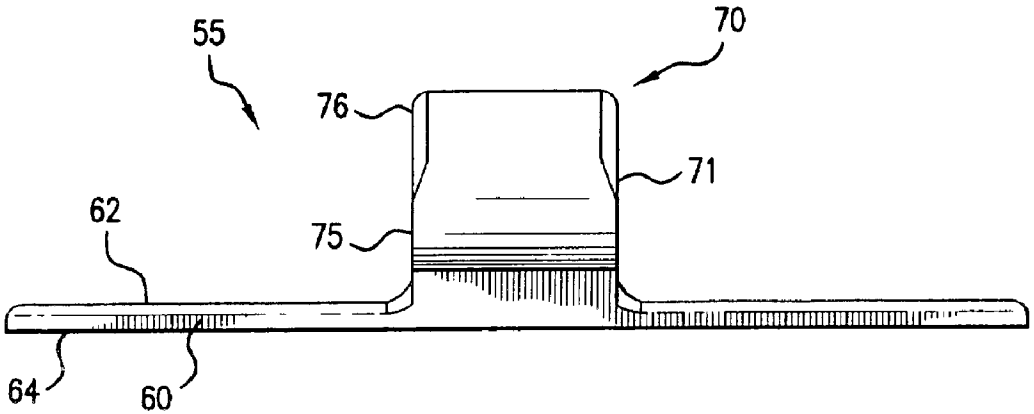
FIG. 5 is a side view of the holding apparatus, as shown in FIG. 3.
Figure 6:
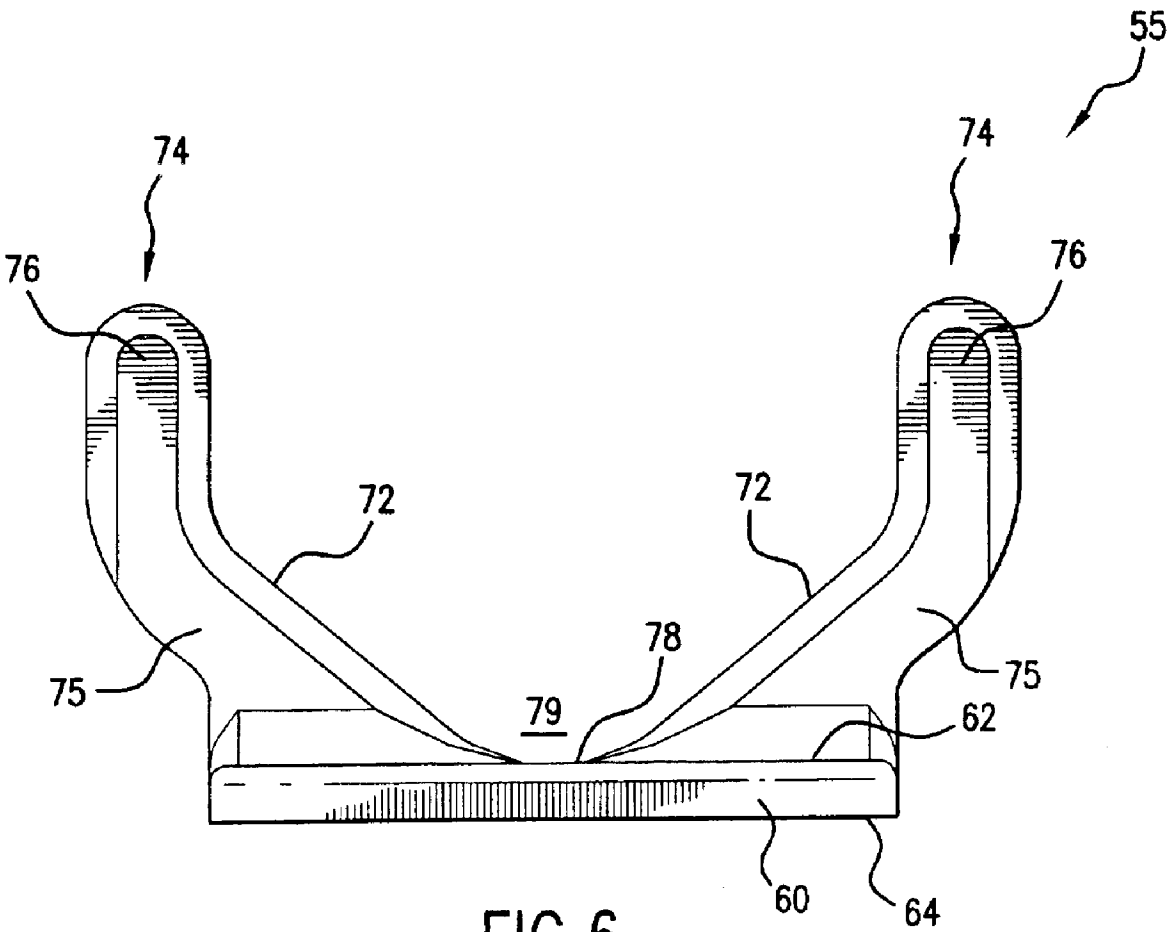
FIG. 6 is a rear view of the holding apparatus, as shown in FIG. 3.
Figure 9:
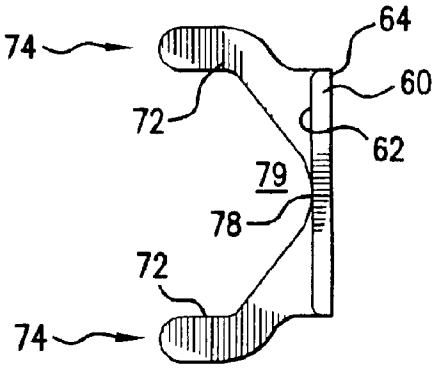
FIG. 9 is a rear view of the holding apparatus, as shown in FIG. 7.
Figure 7:
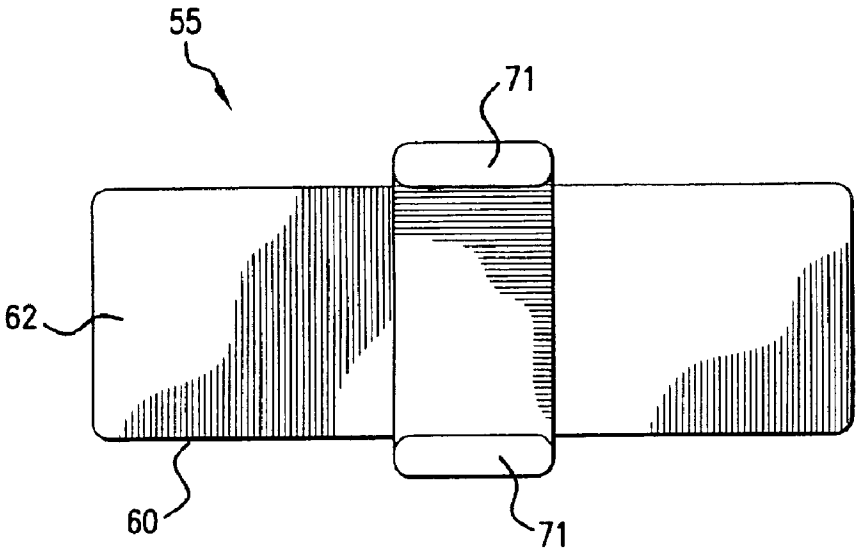
FIG. 7 is a top view of a holding apparatus, according to another embodiment of this invention.
Figure 8:
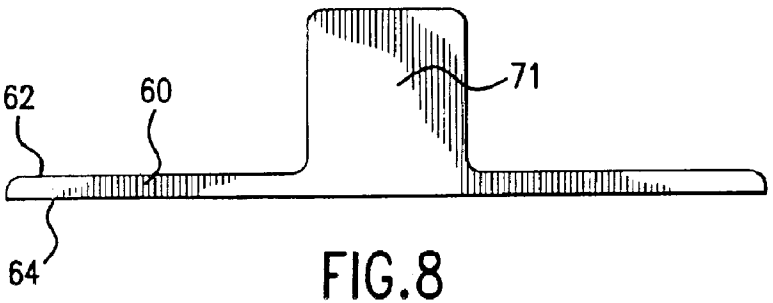
FIG. 8 is side view of the holding apparatus, as shown in FIG. 7.

FIG. 3 shows a perspective view of holding apparatus 55, according to one embodiment of this invention. As shown in FIG. 3, holding apparatus 55 includes base portion 60 integrated with upper portion 70. In other embodiments of this invention, upper portion 70 and base portion 60 may be separate elements attached with respect to each other. FIGS. 4–6 show other views of holding apparatus 55 as shown in FIG. 3. FIGS. 7–9 show another embodiment of holding apparatus 55, according to this invention.

As shown between FIGS. 3–9, base portion 60 has top surface 62 and opposite bottom surface 64. In one embodiment of this invention, bottom surface 64 is relatively planar when holding apparatus 60 is not attached to archery bow 15. Base portion 60 is also preferably relatively flexible, so that base portion 60 can be mounted to and conform with a portion of archery bow 15 which is either flat or which has one or more curvatures. A double-sided tape or other suitable adhesive or adhesive layer can be used to fix holding apparatus 55 with respect to archery bow 15.

Upper portion 70 has two opposing walls 71 spaced apart from each other and extending outward, away from top surface 62. As shown in FIGS. 3, 6 and 9, upper portion 70 has a fork configuration, wherein opposing walls 71 form prongs 74 of the fork configuration. When looking at a rear view of the fork configuration, such as the views shown in FIGS. 6 and 9, upper portion 70 can have a generally U-shape cross section, a generally V-shape cross section or any other suitable cross section.

As shown in FIGS. 6 and 9, free end portions 76 of walls 71 are generally parallel to each other. However, opposing walls 71 can also be non-parallel with respect to each other. Inner surfaces 72 of walls 71 contact the shaft of arrow 16 and frictional forces hold arrow 16 with respect to holding apparatus 55, particularly when archery bow 15 is moved into different carrying positions or other three-dimensional positions. As shown in FIG. 6, in one embodiment of this invention, intermediate portions 75 of walls 71 diverge from each other in a direction outward from top surface 62. As shown in FIGS. 6 and 9, upper portion 70 forms clearance void 79 which is preferably deep enough to provide clearance for the shaft and/or the fletching of arrow 16. As arrow 16 discharges from archery bow 15, as shown in FIGS. 6 and 9, inner surfaces 72 of intermediate portions 75 meet each other to form trough 78. Trough 78 is preferably deep enough to form clearance void 79. Depending upon the overall shape and/or dimensions of upper portion 70, it may or may not be necessary to form clearance void 79, to provide clearance for the shaft and/or the fletching of arrow 16. As shown in FIG. 6, a distance between inner surfaces 72 and top surface 62 is at a minimum near or at a location of trough 78.

In one embodiment of this invention, trough 78 is linear or forms a two-dimensional line. In another embodiment of this invention, trough 78 forms a planar surface. In yet another embodiment of this invention, trough 78 forms an arcuate or non-planar surface.

In one embodiment of this invention, inner surfaces 72 have a matte finish or are otherwise roughened to provide sufficient frictional resistance between inner surface 72 and the shaft of arrow 16, for holding the shaft of arrow 16 with respect to holding apparatus 55.

Base portion 60 and/or upper portion 70 are preferably of a polymeric material or a rubber material. However, base portion 60 and/or upper portion 70 can be of any other suitable material that provides flexibility for attachment with respect to archery bow 15.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An apparatus for holding an arrow, the apparatus comprising:

a movable arrow rest, a holding apparatus with a base portion having a bottom surface and a top surface, an upper portion integrated with said base portion, said upper portion having two opposing walls spaced apart from each other and each extending outward from said top surface, and said upper portion having a generally U-shape cross section.

2. An apparatus for holding an arrow, the apparatus comprising:

a movable arrow rest, a holding apparatus with a base portion having a bottom surface and a top surface, an upper portion integrated with said base portion, said upper portion having two opposing walls spaced apart from each other and each extending outward from said top surface, and said upper portion having a generally V-shape cross section.

3. An apparatus for holding an arrow, the apparatus comprising:

a movable arrow rest, a holding apparatus with a base portion having a bottom surface and a top surface, an upper portion integrated with said base portion, said upper portion having two opposing walls spaced apart from each other and each extending outward from said top surface, and in a direction generally parallel to a longitudinal axis of the arrow when loaded in the apparatus, said base portion having a length greater than said upper portion.

4. An apparatus for holding an arrow, the apparatus comprising:

a movable arrow rest, a holding apparatus with a base portion having a bottom surface and a top surface, an upper portion integrated with said base portion, said upper portion having two opposing walls spaced apart from each other and each extending outward from said top surface, and free end portions of said opposing walls generally parallel to each other.

5. The apparatus according to claim 4, wherein said upper portion has a fork configuration and said opposing walls form prongs of said fork configuration.

6. In the apparatus according to claim 4, wherein intermediate portions of said opposing walls diverge from each other in a direction outward from said top surface.

7. In the apparatus according to claim 4, wherein said bottom surface of said base portion is generally planar.

8. In the apparatus according to claim 4, wherein inner surfaces of said opposing walls each has a matte finish.

9. In the apparatus according to claim 4, wherein said base portion and said upper portion merge into each other.

10. In the apparatus according to claim 4, wherein at least one of said upper portion and said base portion is of a polymeric material.

11. An apparatus for holding an arrow, the apparatus comprising:

a movable arrow rest, a holding apparatus with a base portion having a bottom surface and a top surface, an upper portion integrated with said base portion, said upper portion having two opposing walls spaced apart from each other and each extending outward from said top surface, intermediate portions of said opposing walls diverging from each other in a direction outward from said top surface, and inner surfaces of said intermediate portions meeting each other to form a trough.

12. In the apparatus according to claim 11, wherein said trough is deepened to form a clearance void for fletching of the arrow.

13. In the apparatus according to claim 11, wherein a distance between said inner surfaces and said top surface of said base portion is at a minimum at a location of said trough.

14. In the apparatus according to claim 11, wherein said trough is linear.

15. In the apparatus according to claim 11, wherein said trough is planar.

16. In the apparatus according to claim 11, wherein said trough is arcuate.

17. An apparatus for holding an arrow, the apparatus comprising:

a movable arrow rest, a holding apparatus with a base portion having a bottom surface and a top surface, an upper portion integrated with said base portion, said upper portion having two opposing walls spaced apart from each other and each extending outward from said top surface, and inner surfaces of said opposing walls each generally perpendicular to said bottom surface.

18. An apparatus for holding an arrow, the apparatus comprising:

a base portion having a bottom surface and a top surface, an upper portion integrated with said base portion, said upper portion having two opposing walls spaced apart from each other and each extending outward from said top surface, a support element aligned with said base portion, said support element movable between a first position and a second position, a bias element urging said support element toward said first position, a flexible inelastic member having a first end portion fixed with respect to a cable slide and a second end operatively connected to said support element, and with said support element in said second position said flexible inelastic member being in a tension condition.

* * * * *